United States Patent [19]

Davis

[11] Patent Number: 4,850,502

[45] Date of Patent: Jul. 25, 1989

[54] DETACHABLE HANDLE SYSTEM

[76] Inventor: James B. Davis, 1015 N. Kings Rd., Los Angeles, Calif. 90069

[21] Appl. No.: 904,349

[22] Filed: Sep. 5, 1986

[51] Int. Cl.[4] ..... B65D 25/00

[52] U.S. Cl. ..... 220/94 R; 224/901; 16/114 R

[58] Field of Search ..... 220/94 R; 224/901; 294/27.1; 229/52 A; 383/13; 16/114 R

[56] References Cited

U.S. PATENT DOCUMENTS

| | | | |
|---|---|---|---|
| 2,537,750 | 1/1951 | Gretschel | 16/114 R X |
| 3,782,620 | 1/1974 | Eichhole | 16/114 R X |
| 4,345,704 | 8/1982 | Boughton | 224/901 X |

*Primary Examiner*—Steven M. Pollard
*Attorney, Agent, or Firm*—Koppel & Jacobs

[57] ABSTRACT

A detachable handle system is described which is capable of temporarily placing handles on a container to aid in lifting and transporting the container. The invention is comprised of at least two handles, base members attached to opposed vertical surfaces of the container and mounting means fixed to the handles. In the preferred embodiment, the base members and mounting means are two cooperating sheets of a hook and loop fastener, commonly known by the trademark Velcro. In an alternate embodiment, the base member is a matrices of flexible resilient fibers blown onto a layer of viscous material on opposed surfaces of the container. One of the Velcro sheets includes a plurality of flexible hook elements and the cooperating sheet includes a plurality of flexible loop elements. The hook and loop elements interact to form a contact bond which is capable of withstanding a substantial shearing force exerted between the base member and the mounting means. The base members and the mounting means are brought together so that the handles, which are used to lift and carry the container, extend from opposed sides of the container. When the container reaches its destination the handles are detached by pulling them and their attached mounting means down and away from the container and the base member. This system provides an effective and efficient means for lifting and transporting containers.

10 Claims, 4 Drawing Sheets

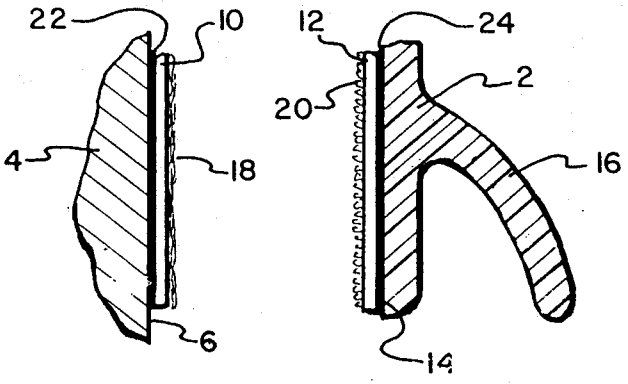
FIG.7.
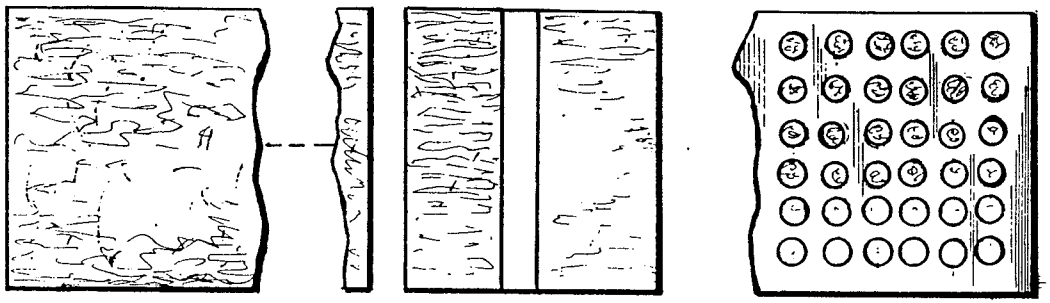
FIG.8.
FIG.9.
FIG.10.

DETACHABLE HANDLE SYSTEM

BACKGROUND OF THE INVENTION

1. Field of the Invention

This system relates to temporary handles that are removably attachable to a cumbersome item. Specifically, the system relates to a plurality of handles attached to opposed sides of a container, for the convenient lifting and transporting of the container.

2. Description of the Prior Art

Most containers are constructed with smooth, lateral, vertical sides that make them difficult to lift. Access to the bottom surface of the container is required to achieve the grip needed to lift the container. Fingers are usually slid under the container to apply the upward force needed to lift. This method can prove to be quite painful and may also lead to back strain, an occurrence that is commonly suffered when an improper technique is used to lift heavy boxes.

Often, more than one person is needed to lift and transport a very large or cumbersome container. Both carriers must get a firm hold on the container and the movement and progression of the carriers must be coordinated to avoid any accidents. This is difficult to accomplish, especially since one carrier usually must face in the direction opposite that travelled. The result can be an uncomfortable and awkward attempt to transport a container.

Many containers have been constructed with permanent handles, either as projections or apertures found on the vertical surfaces of the container. Additional projections on the vertical sides of the container are very inconvenient, requiring more room in storing and stacking the containers, and can be broken off or damage adjacent containers. Fibrous containers made of cardboard are often disassembled and stacked in flat piles for storage. Permanent handles projecting from the container would make this very difficult to accomplish. It is preferred that containers do not contain apertures. Any discontinuity in the vertical face of the container would cause a material weakness, diminishing the ability to reuse the container. Apertures in the container would also expose the container's inner contents to moisture and other elements, causing possible damage to the contents. In many cases, the inner contents would be severely damaged if exposed to these elements.

A number of systems for lifting and transporting containers have been developed, with varying degrees of success. U.S. Pat. No. 3,311,126 to Cornish (1962) illustrates the problems which accompany openings in the sides of a container. The patent discloses a system for reinforcing these openings. A wire loop, preferably of such a shape and size to substantially frame the handle opening, is fixed to the inside surface of the container and serves as a hand hold for the container. The wire loop is fastened to the end section of the container by strips of tape which are folded around the loop, and adhered to the end walls of the container to distribute the load and prevent the container from tearing.

U.S. Pat. No. 3,301,452 to Jester (1967) discloses handles constructed of two-ply paper reinforced by threads. The upper half of the two-ply paper is wrapped around a dowel pin which serves as a handle. The bottom half of the paper includes an adhesive surface. Each adhesive surface is placed near opposite top edges of the container. The handles extend upward from the top edges when carrying a load and hang adjacent to the vertical side walls of the container when not in use. This device fails to account for the weight of a filled container. The container's weight creates a shearing force between it and the adhesive surface of the two-ply paper. It would be difficult for the adhesive strength of the paper to withstand the shearing force present, creating the strong possibility that the handles would pull away from the container when it is lifted. The adhesive used on this device is not reuseable and the handles must either be discarded or left to hang from the container, creating an inconvenience during storing.

U.S. Pat. No. 4,226,349 to Uccellini (1980) uses a pair of handles with a plurality of pointed projections oriented from the handle at 45° angles. The handles are designed to engage opposite, vertical sides of a fibrous container. While not completely penetrating the container, the device does puncture its outer surface and diminishes the material strength of the cardboard. After a container has been repeatedly subjected to these handles its outer surface may be seriously damaged. Because the handles are unable to penetrate a metal container, the use of this device is limited to fibrous containers, such as cardboard.

The foregoing devices represent improvements in the lifting and transporting of large containers. However, most of these devices do not take into account the shearing force present when a large container is lifted. In most cases the handles may detach from the container when the initial force needed to lift the container is applied. In order for handles to be effective they must not puncture or deface the surface of the container, they must be able to withstand the shearing force present between the handles and the container during lifting and transporting, and they should not interfere with stacking the containers when either assembled or unassembled. The prior art is unable to meet these requirements. Manually lifting and transporting containers may prove to be more efficient and effective than the devices disclosed in the prior art.

Several devices exist in unrelated fields which use the hook and loop fasteners used in the present invention. These hook and loop fasteners are commonly provided under the trademark Velcro. A Velcro fastener is a releasibly interlocking system comprised of two cooperating sheets, each with an adhesive backing. The first sheet has a plurality of flexible loop elements made of a resilient material, i.e. nylon. The second sheet has a plurality of flexible hook elements made from the same material. The two sheets are brought together so that generally each hook element interacts with a loop element. In U.S. Pat. No. 3,128,514 to Parker, et al. (1964), a device is disclosed for securing a writing instruction to a support by adhering the first Velcro sheet to the writing instrument and the cooperating Velcro sheet to the support. U.S. Pat. No. 3,235,926 to Mates (1966) uses Velcro fasteners to easily and quickly attach and securely hold drapery hardware to the drapery. U.S. Pat. No. 3,368,811 to Finney (1968) applies a Velcro sheet to the palm of a glove and a cooperating Velcro sheet to a handle. This device is intended to enable a person to grip the handle of a sporting implement or to control the wheel of an airplane, automobile or boat with a secure, non-slip grip. In U.S. Pat. No. 3,499,102 to Gillemot, et al. (1970), Velcro fasteners are used to attach a protective cover to a support surface without defacing the surface and without the need to penetrate the surface with fastening devices. This device is commonly used to conceal an anchor cable coupling for communication equipment. U.S. Pat. No. 3,893,725 to Coulter, et al. (1975) attaches two Velcro sheets to opposite sides of a trash can. The two sheets are brought together to latch down the trash can cover. U.S. Pat. No. 4,202,139 to Hong, et al. (1980) discloses a hand held sanding pad. Sand paper is adhered to one surface of the sanding pad and Velcro fasteners are used to attach a handle to the opposite surface of the sanding pad. A towel and mounting method is disclosed in U.S. Pat. No. 4,403,366 to Lucke (1983). A towel containing a first Velcro sheet is detachably held by a support member containing the cooperating Velcro sheet. U.S. Pat. No. 4,418,733 to Kallman (1983) discloses a pouch with a Velcro segment, adapted to hold and insulate an open beverage and capable of being attached and removed from a support surface containing the cooperating Velcro segment.

SUMMARY OF THE INVENTION

In view of the above problems associated with the prior art, the object of the present invention is the provision of a novel and improved detachable handle system for conveniently lifting and transporting cumbersome items.

Another object of the invention is the provision of a system and method for lifting and transporting containers that is capable of withstanding the shearing force that exists between the handles and the container, without puncturing the surface of the container. A further object is the provision of a system and method that does not interfere with the high density storing and stacking of containers, whether the containers are assembled or disassembled. An additional object of the present invention is the provision of a system and method that promotes the use of a proper technique when lifting a container, thus helping to reduce the possibility of back strain caused by the improper lifting of the container.

In the achievement of these and other objects of the present invention, a detachable and reuseable handling system is provided for lifting and transporting containers. The reuseable handling system is comprised of flat base members permanently mounted onto opposed sides of a container, a plurality of handles adapted to project from the container, and mounting means located on a surface of each handle. Each base member is adapted to cooperate with a mounting means to form an interlocking mechanism by which a handle can be releasably secured to the side of the container. This system allows for the efficient lifting and transporting of cumbersome or heavy containers.

In the preferred embodiment, each handle is comprised of a projection adapted to be firmly held by the carrier of the container, and a flat planar surface spaced from the projection. The handle is constructed of one piece plastic molding, but may also be constructed of other material. The base members and the mounting means are comprised of Velcro type fasteners, or a similar material. The interaction between the base members and the mounting means forms a powerful connection that has a substantial shearing strength and tensile strength, and is capable of withstanding considerable forces.

The base member may be a Velcro sheet containing a plurality of flexible loop elements, which is permanently adhered to the outer surface of the container by means of an adhesive backing on the Velcro sheet. The base member may be arranged on the container as a series of dots or strips, or as a pad. It may also be formed from a matrix of flexible resilient fiber blown onto a layer of viscous material on the surface of the container. The mounting means may be a Velcro sheet containing a plurality of flexible hook elements. The Velcro sheet is adhered to the flat planar surface of the handle by means of the adhesive backing. As with the base member, the mounting means may be adhered to the handle as a series of dots or strips, or as a pad which encompasses substantially the entire area of the flat surface.

The detachable handle system can be tailored to accommodate containers made of a variety of materials in many different shapes and sizes. Because the base member has an adhesive backing and does not puncture the container, it can be used on metal containers and on fibrous containers with sensitive inner contents. The system's load bearing capability can be increased simply by enlarging the area of contact between the base member and mounting means. This allows the system to bear the weight of heavier containers by increasing the shearing ability of the handling system to match the increase in the container's weight. Heavier containers can also be accommodated by adding additional base members to the container surface and using additional handles to lift and transport the container.

The powerful connection formed by the contact bond allows the container to be lifted by applying an upward force to the handle projections. The handles are used to transport the container in an easy and convenient manner. When the container is at its destination the handles are easily removed by pulling them down and away from the base member and the container. The handles can then be used to lift and transport additional containers.

Further objects and features of the invention will be apparent to those skilled in the art from the following detailed description of preferred embodiments, taken together with the accompanying drawings, in which:

DESCRIPTION OF THE DRAWINGS

FIG. 7 is a side view of the two components of the present invention being brought together.

FIGS. 8, 9 and 10 are plan views of different arrangements of the material used to adhere the handle to a container.

DETAILED DESCRIPTION OF PREFERRED EMBODIMENTS

Figure 1:
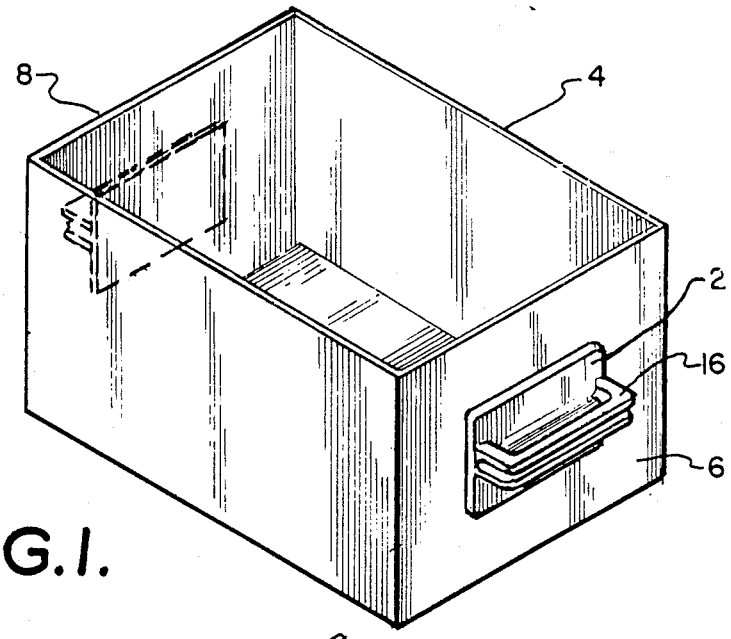
FIG. 1 is a perspective view of the detachable handle system of the present invention attached to a cardboard container.

A detachable handle system is designed to aid in the efficient lifting and transporting of cumbersome items by temporarily affixing handles onto the items, as illustrated in FIG. 1. In most instances, the cumbersome items are containers 4 constructed with smooth, vertical side walls. The temporary handles are attached to the surface of opposed vertical sides 6 and 8 of the containers. The system should be positioned on the surface of the container so as to provide the carrier with the optimum leverage in lifting and most comfort in carrying, taking into account the container's center of gravity.

Figure 2:
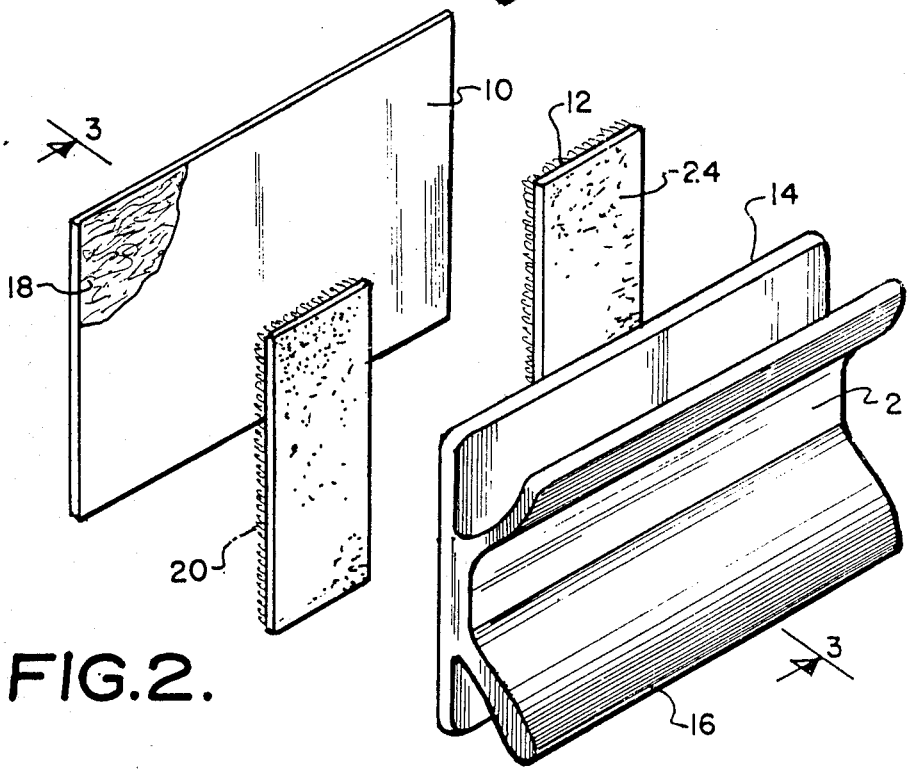
FIG. 2 is a fragmentary, exploded view of one handle of the present system relative to a container.
Figure 3:
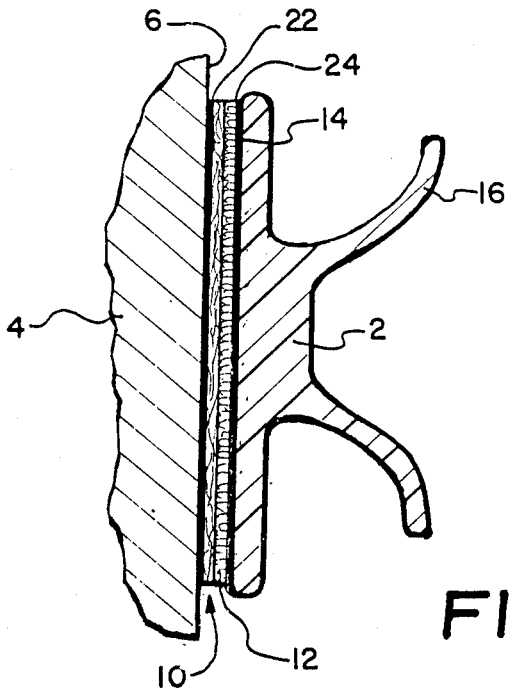
FIG. 3 is a sectional view taken along line 3—3 of FIG. 2.

The principle components of the system are shown in FIGS. 2 and 3 and include base members 10 which are permanently fixed to opposed vertical surfaces 6 and 8 of container 4, mounting means 12 which cooperates with the base members 10 to form a releasibly interlocking mechanism, and at least two handles 2 onto which the mounting means is fixed.

The handles 2 are comprised of a flat planar surface 14 and a projection 16 spaced from the flat planar surface. They are constructed of a one piece plastic molding, but may also be constructed of other material. The projection 16 is adapted to be gripped by the carrier of the container and can be manufactured in many different designs, as illustrated in FIGS. 2–6.

Base members 10 and mounting means 12 are comprised of hook and loop fasteners, commonly known under the trademark Velcro. Velcro is a trademark for a releasably interlocking system comprised of two cooperating sheets, each with an adhesive backing. The two sheets include a plurality of flexible elements made of a resilient material, i.e., nylon. The first Velcro sheet contains a plurality of flexible loop elements 18 and the second sheet contains a plurality of flexible hook elements 20. The two sheets are brought together, as illustrated in FIG. 3, so that generally each hook element interacts with a loop element. The interaction between the flexible elements creates a contact bond which forms a powerful connection between the two sheets.

As shown in FIG. 2, the base member 10 is permanently held to the surface of a vertical side wall of the container by the adhesive backing 22. The base member 10 is comprised of one sheet of Velcro which may be applied to the container as a pad. The mounting means 12 are equal in number to the base members, and are comprised of the Velcro sheet that cooperates with the base member. The mounting means 12 are fixed to the handles 2 by way of the adhesive backing 24 and may be arranged as strips down the length of the planar surface of the handles as illustrated in FIG. 2.

The base members 10 have many advantages over previous devices used to lift and transport containers. The adhesive make up of the backing on the members precludes the need to puncture the container surface in order to achieve the needed friction to lift the container. This allows the invention to be used on metal containers and machinery, and it also ensures that fibrous containers are not effected or weakened by punctures or discontinuations in their outer surface. The general flat nature of the base member 10 does not interfere with the stacking and storing of the containers, and does not require additional storage space to accommodate projections on the surface of vertical side walls of the container. The flexible qualities of the base member 10 allow it to be placed on containers or cumbersome items of all material, in all shapes and sizes. Because the base member is flexible, it can be curved to fit on circular containers, angled to fit around corners or made to lie on generally any surface. The handles can also be designed to accommodate these shapes. A handle with a curved planar surface can be used to lift and carry circular containers, while a handle with an angled surface can be used to lift and carry a container by its corners.

The sheets that comprise the Velcro hook and loop fasteners may be interchanged so that the base member 10 is comprised of hook elements and mounting means 12 is comprised of the loop elements of the Velcro fastener. Either arrangement will prove equally effective.

Figure 4:
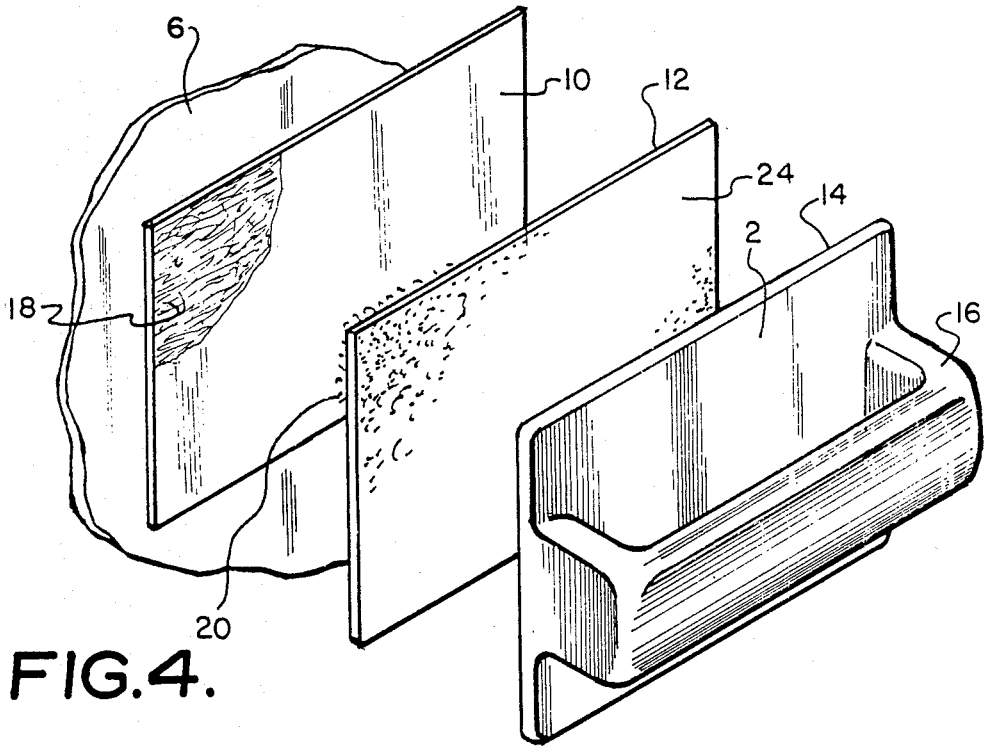
FIG. 4 is an exploded view of a second embodiment of the handle within the present invention.

The preferred embodiment of the mounting means is illustrated in FIG. 4 and employs the hook portion of a Velcro hook and loop fastener arranged as a pad that covers substantially the entire planar surface of handle 2. The pad provides maximum shearing strength and the greatest ease and efficiency in applying the mounting means 12 to handle 2.

Figure 5:
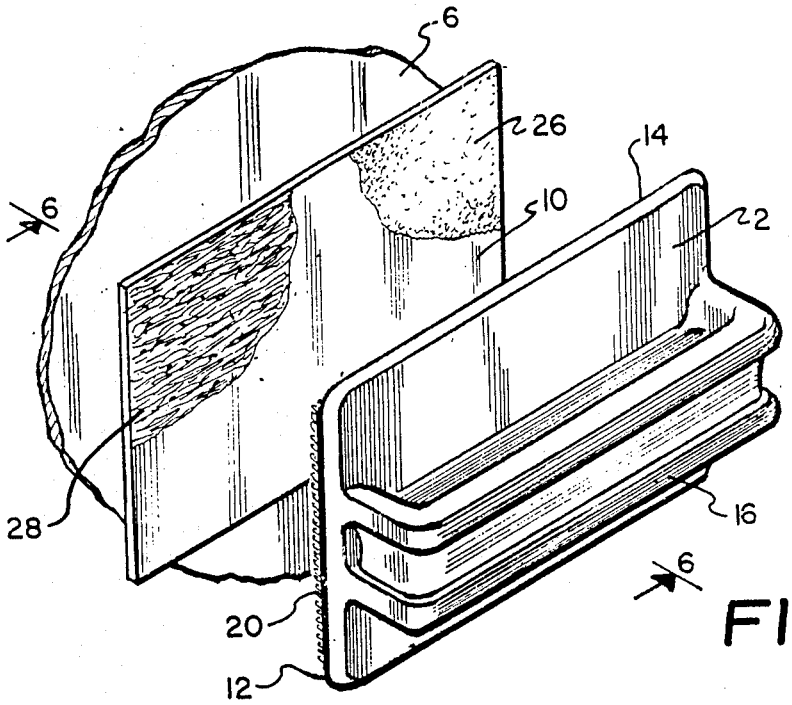
FIG. 5 is a fragmentary, exploded view of a third embodiment of a handle of the present invention.
Figure 6:
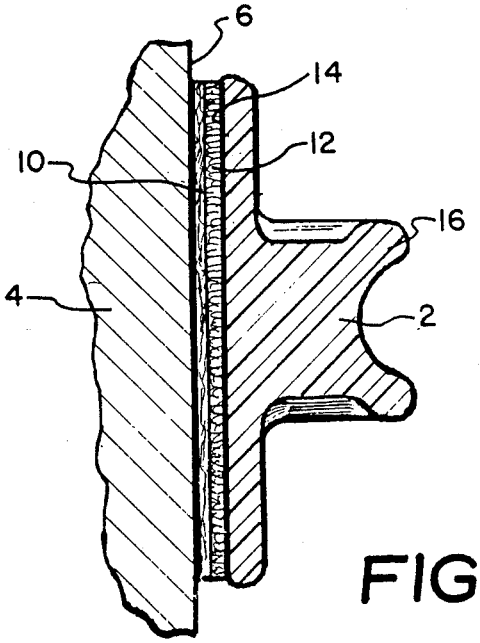
FIG. 6 is a sectional view along line 6—6 of FIG. 5.

An alternate embodiment of the present invention is illustrated in FIGS. 5 and 6. A stencil, or similar device, is used to set the boundaries for a layer of viscous material 26 that is applied to opposed vertical side surfaces 6 and 8 of container 4. The stencil may set the shape of the viscous material as a rectangle, a series of strips, or a plurality of dots. The viscous material used may be glue, or a similar substance. A plurality of flexible resilient fiber is blown onto the respective viscous layers to form matrices. The flexible fibers preferred are similar to the nylon hooks and loops found on the surface of Velcro sheets. It is preferred that the flexible fibers 28 and the viscous material 26 be transparent to allow any advertisement or instructions printed on the vertical side surfaces of the container to be visible.

The base member and the mounting means are brought together as shown in FIG. 7 so that generally each hook element 20 on mounting means 12 interacts with a loop element 18 on the base member 10. This interaction creates a releasably interlocking mechanism which limits the motion of base member 10 along mounting means 12 when a lateral force exists between the two sheets. The Velcro sheets comprising the mounting means and the base members may be placed on the container and the handles as pads (FIG. 8), strips (FIG. 9), or dots (FIG. 10), or any combination of these. The different orientations offer a variety of shearing strengths and appearances.

The interaction of base member 10 and mounting means 12 creates a contact bond which forms a powerful connection between the two Velcro sheets. This contact bond is capable of withstanding the lateral forces present between the base member and the mounting means when the container is lifted. When a container is lifted, the lateral force present between the two sheets is a shearing force which is equal, but opposite to the weight of the container. The shearing force is divided equally among the number of handles used to hold up the container. The two sheets of Velcro are capable of withstanding a shearing force of over 40 psi. The greater the area of contact between the base member 10 and the mounting means 12, the greater a shearing force that can be withstood and the greater a load that can be lifted by the handling system. In most cases, the load in the container will exceed the lifting ability of the carrier before it exceeds the shearing strength of base member 10 and mounting means 12.

When the base member 10 and the mounting means 12 are brought together, the handle projection 16 extends from the container and provides the means by which the container is lifted. The use of the handles will promote the use of a proper method in lifting containers and will help to reduce the possibility of back strain caused by improper lifting and transporting of containers.

If an exceptionally heavy load causes the handles to shear from the container, additional handles and base members may be added to the system. The additional handles will reduce the shearing force at each handle by a proportionate amount and allow the system to bear a greater total load.

The detachable handle system can easily be used by more than one carrier. Each carrier is able to get a firm grip on at least one handle 2 and, if desired, can face the direction travelled. The system may be used so that each carrier grips a handle on opposed sides of the container 4 or the carrier may use two handles placed on the same or adjacent sides of the container. Two carriers using four handles would be able to lift and carry a container with a greater load without shearing the handles from the container.

After the container has been placed in its designated location the handles 2 can be detached from the container by pulling the handles and the mounting means down and away from the container and the base members. Because the handles are detachable less room is required in storing and stacking the containers.

Both the handles and the base members of the detachable handle system are reusable. After the handles are detached from the first container, they can be attached to base members of additional containers and used to lift and transport these containers. After the first set of handles are used to load the containers a second set of handles and the original base members can be used to unload the containers. The system can be used to lift and transport the same containers several times without damaging the container.

The detachable handle system can also be used with a robotic system. In many instances, robotic arms are used to lift and transport boxes. The mounting means may be attached directly to the robotic arms so that the robotic arms are used in place of the handles. The robotic system can be programmed to lift, transport and detach from the container.

A novel detachable handle system, which is efficient and effective to use, has thus be shown and described. As numerous modifications and alternate embodiments will occur to those skilled in the arts, it is intended that the invention be limited only in terms of the appended claims.

I claim:

1. A system for carrying a container, comprising:

at least two base members permanently attached to and protruding outwardly from opposed sides of the container, the base members including hook and loop fastening material distributed along their surfaces facing outward from the container; and at least two handles having respective gripping means on one side, and hook and loop fastening material complementary to the hook and loop fastening material on respective base members distributed along an opposed side, the hook and loop fastening materials of the base members and handles being oriented to enable the handles to be mated with and temporarily attached to respective base members for lifting the container.

2. The system as defined in claim 1, wherein the base members comprise matrices of flexible resilient fibers blown onto respective layers of viscous adhesive material on the surface of the container.

3. The system as defined in claim 1, wherein the base members are flat to reduce interference with stacking and storing the container.

4. The system as defined in claim 1, wherein the base members are attached to the container by adhesive means which do not puncture or destroy the container surface.

5. The system as defined in claim 4, wherein the adhesive means is an adhesive backing on the base members.

6. A method for carrying a container, comprising:

permanently mounting a plurality of base members comprised of one portion of a hook and loop fastener to the container with the base members protruding outwardly from the container;

bringing handles which include portions of a hook and loop fastener which are complementary to the hook and loop fastener of the base members into contact with respective base members;

using the handles to lift the container; and disengaging the handles from the container after completing the lifting operation, thereby providing a method that promotes the use of a proper technique to help reduce the possibility of back strain when lifting a container.

7. The method as defined in claim 6, wherein the base members are flat to reduce interference with stacking and storing the container.

8. The method as defined in claim 6, wherein the base members are attached to the container by an adhesive backing that does not puncture or destroy the container surface.

9. A method for attaching handles to a container having generally vertical side walls, comprising:

placing a stencil against at least two vertical side walls of the container;

spraying viscous adhesive material at the stencil and onto the side walls of the container;

blowing flexible hook and loop fastener fibers onto the viscous material to form respective base members which protrude outwardly from the container walls;

bringing handles which include portions of a hook and loop fastener which are complementary to the hook and loop fastener fibers of the base members into contact with the base members;

using the handles to lift the container; and disengaging the handles from the container after completing this lifting operation.

10. The method as defined in claim 9, wherein the base members are flat so reduce interference with stacking and storing the container.

* * * * *